US006124673A

United States Patent [19]

Bishop

[11] Patent Number: 6,124,673

[45] Date of Patent: Sep. 26, 2000

[54] UNIVERSAL ARC-DISCHARGE LAMP SYSTEMS

[76] Inventor: James G. Bishop, 19229 Briarwood La., Strongsville, Ohio 44136

[21] Appl. No.: 09/135,029

[22] Filed: Aug. 17, 1998

Related U.S. Application Data

[63] Continuation-in-part of application No. 08/826,673, Apr. 7, 1997, abandoned.

[51] Int. Cl.[7] ..... H01J 7/44

[52] U.S. Cl. ..... 315/56; 315/57; 315/363; 362/260

[58] Field of Search ..... 315/56, 57, 58; 362/260, 226

[56] References Cited

U.S. PATENT DOCUMENTS

| | | | |
|---|---|---|---|
| 4,570,105 | 2/1986 | Engel | 315/58 |
| 4,645,283 | 2/1987 | MacDonald et al. | 339/50 R |
| 4,723,200 | 2/1988 | Troen | 439/236 |
| 4,752,718 | 6/1988 | Strauss et al. | 315/73 |
| 4,754,197 | 6/1988 | Zwald | 315/57 |
| 4,792,726 | 12/1988 | Gandhi | 315/52 |
| 4,874,989 | 10/1989 | Nilssen | 315/151 |
| 4,936,789 | 6/1990 | Ugalde | 439/236 |
| 4,939,420 | 7/1990 | Lim | 315/58 |
| 5,015,917 | 5/1991 | Nigg | 315/56 |
| 5,065,292 | 11/1991 | Aubrey | 362/260 |
| 5,073,845 | 12/1991 | Aubrey | 362/226 |
| 5,135,407 | 8/1992 | Berends | 439/236 |
| 5,390,096 | 2/1995 | Dekleine et al. | 362/346 |
| 5,569,981 | 10/1996 | Cho | 315/56 |
| 5,596,247 | 1/1997 | Martich et al. | 315/56 |
| 5,634,820 | 6/1997 | Vakil | 439/236 |
| 5,707,246 | 1/1998 | Perkins | 439/236 |

*Primary Examiner*—Don Wong
*Assistant Examiner*—Tuyet T. Vo
*Attorney, Agent, or Firm*—Christopher J. Whewell

[57] ABSTRACT

Provided herein is a system which permits refitting of lamp sockets which utilize incandescent lamps with fluorescent lamps. The present system provides for a ballast which is remote from the lamp itself, thus being non-restrictive in regards to the size or wattage of the lamps used. The system is universal in that any existing incandescent lamp may be replaced with a fluorescent lamp, including compact fluorescent lamps, of any wattage desired by the user. The systems herein provide an increased degree of safety, as the socket profile can be matched to the ballast connector to preclude the use of an incorrect ballast with a given fluorescent lamp.

16 Claims, 4 Drawing Sheets

UNIVERSAL ARC-DISCHARGE LAMP SYSTEMS

CROSS-REFERENCES TO RELATED APPLICATIONS

This application is a continuation-in-part of application Ser. No. 08/826,673, filed Apr. 7, 1997, now abandoned, the entire contents of which are herein incorporated by reference.

BACKGROUND INFORMATION

Since the earliest of modern times, it has been recognized as desirable to provide a cost-effective means for producing useful, practical illumination from electrical energy. Most inhabitants of modern countries are familiar with various lighting means including incandescent lamps and arc discharge or fluorescent lighting. It is to the art of arc discharge lamps to which the present invention is concerned, to the extent that it is desirable to provide a cost-effective means for retrofitting existing electrical devices which employ incandescent lamps to the use of fluorescent lamps.

The art of arc discharge lamps took a quantum leap with the successful demonstration of the usefulness of these lamps by Charles F. Brush in his March 1880 demonstration in the town of Wabash, Indiana. Mr. Brush's lamps comprised carbon electrodes sealed in a chamber in vacuo along with a prescribed quantity of elemental sodium. The electrons of monatomic sodium vapor contained in the envelope absorb energy and undergo a transition, emitting photons visible as the yellow light frequently observed by passers-by along various highways today. Arc-discharge lamps are generally more desirable than their incandescent counterparts since they produce a relatively large amount of lumens per energy input and dissipate a lessened amount of energy in the form of heat as compared with incandescent lamps. However, the discharge lamps typically require an increased amount of associated hardware relative to incandescent lamps. Accordingly, arc-discharge lamps have only found use where the energy savings can offset the costs of the additional hardwares required. Nevertheless, ever since the initial efforts of Mr. Brush, it has been an ongoing goal of pioneers in the lighting industries to devise such contrivances as may have been believed to render arc-lighting more economically affordable to a larger number of consumers, for various reasons.

Accordingly, the prior art is replete with examples of developments related to reaping the advantages associated with arc lighting. Many of these developments are concerned with the retrofit or use of existing electrical systems which were originally designed for use with incandescent lamps to arc discharge lamp uses. For example, U.S. Pat. No. 5,634,820 describes an adapter module which allows the use of a low-wattage, compact fluorescent lamp in an ordinary light socket. The lamp has a built-in ballast, and the unit as a whole is discarded upon lamp failure; U.S. Pat. No. 5,596,247 describes a fluorescent lamp which is designed to screw into an existing light socket; U.S. Pat. No. 5,135,407 describes a conversion kit which enables the user of a portable work light to substitute a fluorescent lamp in the place of an incandescent lamp; U.S. Pat. No. 5,073,845 describes a retrofit socket useful with fluorescent light fixtures; U.S. Pat. No. 4,936,789 teaches an assembly through which an incandescent lamp may be powered from a standard incandescent lamp socket; and U.S. Pat. No. 4,723,200 teaches a holder for an electric light, all of which, including patents cited as references therein are herein incorporated by reference. However, each of the teachings of the prior art are not without one or more inherent disadvantages rendering them unsuitable for providing en masse adoption of the use of fluorescent lamps in various capacities formerly reserved for incandescent lighting.

Generally speaking, compact arc-discharge lamps or compact fluorescent lamps (CFL's) have power ratings in the range of about 5–50 watts and vary in size accordingly. These fluorescent lamps are not directly interchangeable with the incandescent lamps they are intended to replace owing to the different operating requirements of each. One of the extra items required in an arc lighting system a ballast, which consists essentially of a coil of wire of many turns and which functions to limit the flow of current through the lamp which, in the absence of the ballast would otherwise be practically limitless, thus destroying the fluorescent tube in short order. Therefore, fluorescent lamps have specially designed bases which ensure that they are not inserted into lamp sockets intended for the incandescent. Built-in ballasts are common in fluorescent lamps for wattages up to about 20 W. However, such systems are uneconomical in that when the CFL lamp eventually fails the unit as a whole, including the ballast, must be discarded. For the fluorescent lamps available which contain internal ballasts, the ability to include the ballast in the lamps is limited by the wattage of the lamp. For example, it is not practicable to provide internal ballasts on lamps having wattages greater than about 20 W. Through use of the instant invention, there is no limit to the wattage of the lamp retrofitted. Additionally, it is not necessary to discard the ballast when the lamp fails, as is required by the prior art lamps which contain an internal ballast; hence use of the instant invention saves end user costs and manufacturing resources. Furthermore, in general terms, the present systems possess the drawbacks that: 1) the increase in lamp wattages desired for a particular use are accompanied by a pendant increase in the size of the ballast required; and 2) many of the newer lamps are incompatible with 120 VAC house current and therefore require that special fixtures or lamp/ballast assemblies must be used.

In consideration of the problems above, it would be desirable to have at hand a device or system which provides a means for permitting existing fixtures comprising incandescent lamps to be readily refitted with fluorescent lamps. It is also desirable to provide a means for providing the possibility of the use of a wide range of ballasts in such systems, including those ballasts with normal power factors, high power factors, magnetic, and electronic types. It would also be desirable to provide such a system which is useful with either two-pin type or four-pin type fluorescent lamps. Since higher wattage arc discharge lamps require larger and more complicated ballasts which will not fit existing fixtures, it would also be desirable to have at hand a means for permitting existing incandescent lamp retrofits for use with fluorescent lamps which permit the easy and convenient interchange of different ballasts, external from the adapter or fixture with coordinated connectors for different lamp types. It would also be desirable that such a device comprise a ballast which is remote with respect to the remaining elements of the device. It would also be desirable for such a system to not require the discard of the ballast along with lamp replacement as is common in the present state of this art. Additionally, it is desirable to provide the possibility of the use of a remote dimming ballast to enable the user to control the intensity of the light emitted by the fluorescent lamp.

Also, owing to the inherent design of the circuitry of the instant invention, it is not possible for the lamp to operate in the situation where there is no ballast connected to the adapter. This is of particular advantage in disallowing an unintentional blowout as is readily possible with the devices of the prior art.

The versatility of the instant invention becomes evident when one considers the fact that with low wattage compact fluorescent lamps having their ballast built in, inexpensive electronics are used. However, with the two-pin compact fluorescent lamps a magnetic ballast must be used because the high voltage kick putout by the glo-bottle starter built into the lamp would destroy the electronics. These lamps will operate on common house current (120 VAC). The compact fluorescent lamps having wattages in the range of about 26–42 W will not operate with 120 VAC because the arc tube voltage is greater than 120V and the lamp would not stay lit. A higher lamp voltage must be supplied by the ballast which is the reason why these ballasts are larger, more expensive, and normally separate from the lamp. Also, such higher wattage lamps are of the 4-pin design. By keeping the ballast separate from the lamp it is possible to install any type ballast and control circuit desired. In the teachings of the prior art, none contains any provision for readily changing the ballast to suit the intended application as provided herein. Through use of this invention it is possible to convert to any arc-discharge lamp instead of an incandescent lamp by merely selecting the proper ballast and inserting the desired arc-lamp socket into the adapter herein. Finally, any household floor or table lamp can be adapted to use fluorescent lamps in accordance with the teachings herein. While the prior art has attempted to permit the same, the devices therein taught are much too large or cumbersome to be used in such applications, since the prior art devices are not suited to fit within existing lamp-shade support harps. Through use of the teachings of the instant invention, it is possible to easily convert any existing lamp socket to a 42 watt compact fluorescent lamp, which emits roughly the same number of lumens as emitted by a 250 W incandescent lamp.

SUMMARY OF THE INVENTION

Through use of the devices of this invention, the retrofitting of a wide variety of fluorescent lamps to existing incandescent lamp sockets is now possible for the first time, at a greatly reduced cost and a greatly increased degree of user-friendliness.

The present invention comprises a system which permits the retrofitting of existing incandescent lamps with arc-discharge or fluorescent lamps. At the heart of the invention is an adapter which comprises a base portion having a threaded contact portion and a tip contact portion as is commonly found on commercially available, common light bulbs, wherein the threaded contact portion and the tip contact portion are configured to be screwed into an existing incandescent lamp socket. There is a lamp-receiving portion having a flat surface portion and a side portion, which is attached to the base portion and in which the lamp-receiving portion includes a substantially-rectangular female plug portion adapted to receive a commercially-available fluorescent lamp. The lamp-receiving portion has a means for establishing electrical contact between one of the electrical contacts of the fluorescent lamp power contact and one of either said tip contact portion or said threaded contact portion. Since the ballast to be used is to be in series with the fluorescent lamp employed, there is no preference of polarity as to which of either the tip or thread portion to which either of the lamp contacts is connected. There is also a ballast connective means exiting the side of said lamp-receiving portion, which consists of a first and a second wire, in which the first wire is connected to the threaded contact portion or tip contact portion not previously used and wherein said second wire is connected to the remaining means for establishing electrical contact to the remaining fluorescent lamp power contact.

DETAILED DESCRIPTION OF A PREFERRED EMBODIMENT

Figure 1A:
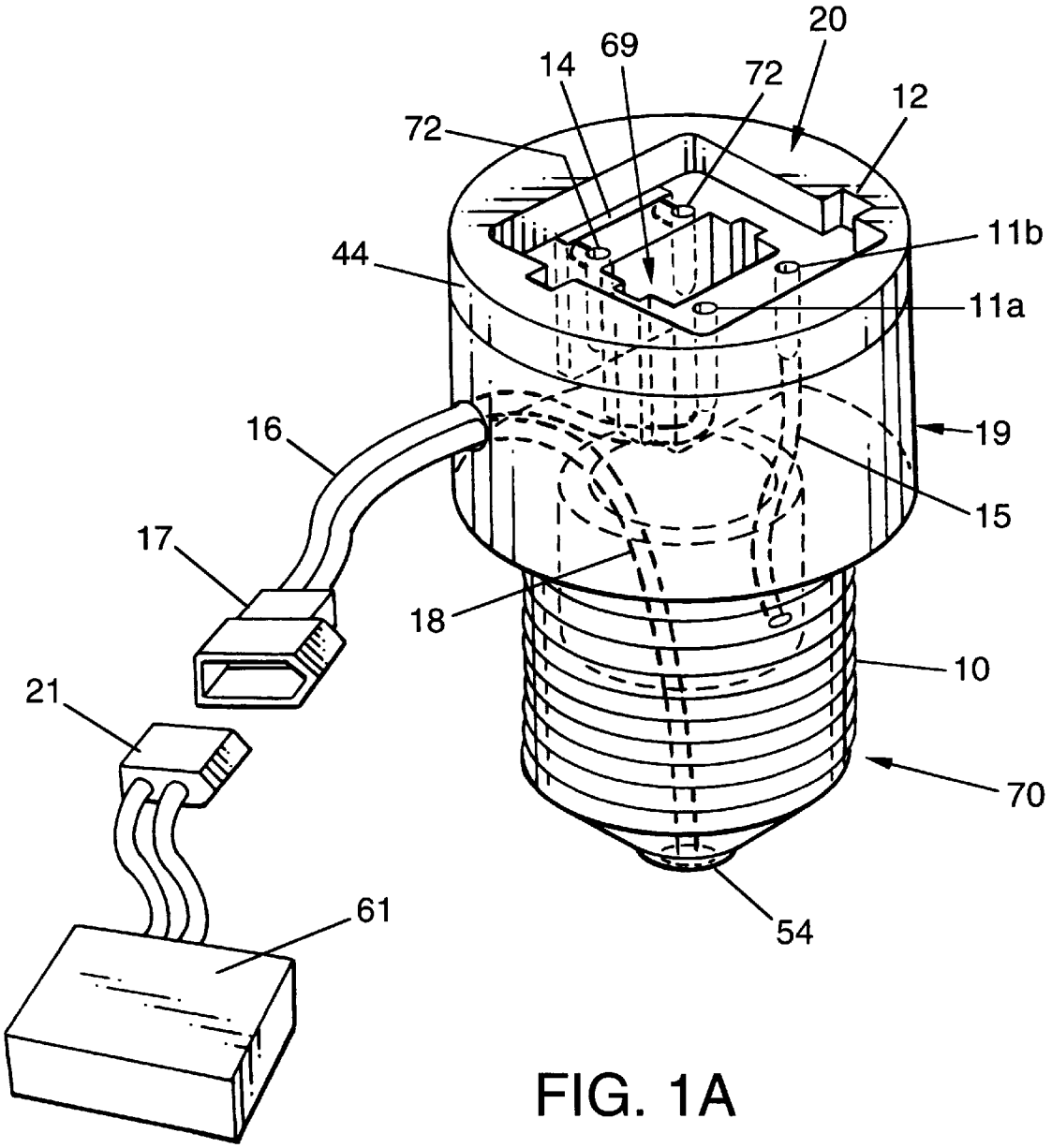
FIG. 1A is a perspective view of a perspective view of the adapter of the invention.
Figure 1B:
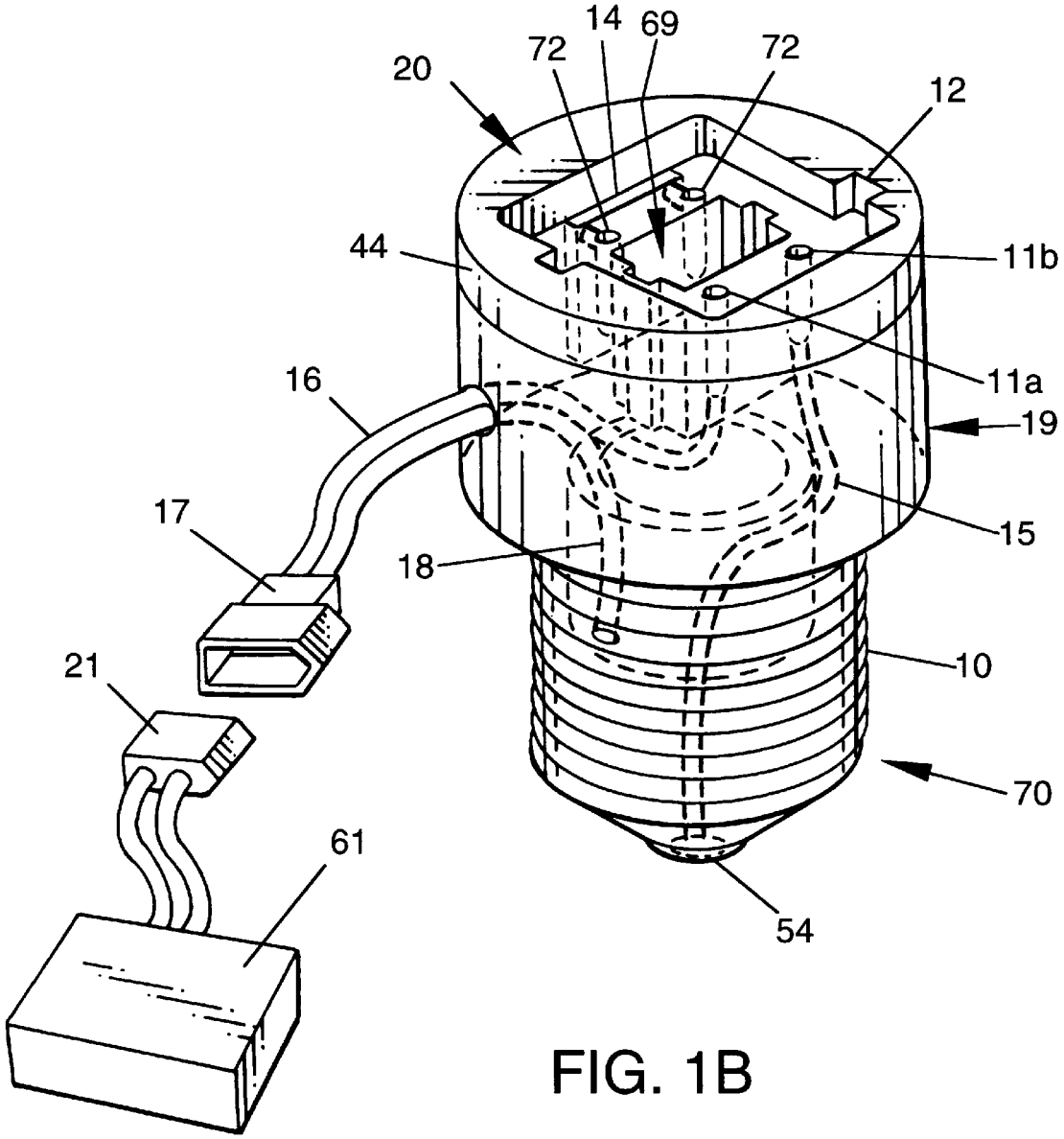
FIG. 1B is a perspective view of a perspective view of the adapter of the invention according to an alternate embodiment.

Referring to the drawings and initially to FIG. 1A there is depicted a perspective view of the adapter of the invention as useful in the retrofit of an incandescent lamp socket with a four-pin type fluorescent lamp. As is evident therefrom, the adapter comprises a base portion 70 which includes a threaded contact portion 10 and a tip contact portion 54, wherein the combined threaded portion and tip portion are configured so as to be readily screwed into an existing incandescent lamp socket. There is a lamp-receiving portion 19 attached to the base portion which is where the fluorescent lamp is to be located. The lamp-receiving portion includes a surface portion 20 in which is included a substantially rectangular female socket portion 69 which is adapted to receive the male portion of an existing commercially available fluorescent lamp. There is a ballast connective means 16 which in the preferred embodiment comprises two wires wherein the first of the wires 18 is connected to one of the poles of the electrical source. In this regard, it is not relevant whether wire 18 is connected to the threaded contact portion 10 or to the tip contact portion 54, since polarity is not an issue. The second wire of the ballast connective means 16 is contacted with a means for establishing electrical contact 11*a* with one of the power supply electrical contacts of the fluorescent lamp used. Preferably, this means for establishing electrical contact 11*a* is a single female socket (sheath) which provides for an interference fit with the corresponding male pin on the fluorescent lamp used, and is located within a recess in the lamp-receiving portion 19. The remaining means for establishing electrical contact 11*b* is in electrical contact with the threaded contact portion 10 by means, preferably, of a wire 15, although, again, polarity is not an issue. Electronic starter 14 is shown recessed in the lamp-receiving portion and in contact with a means for establishing electrical contact 72 with both of the trigger contacts of the fluorescent lamp used. These are the same sheath-type female sockets as are 11. Finally, the ballast connective means 16 is terminated with a connector 17 which allows for the convenient and rapid connection and disconnection of a ballast which is fitted with a connector (not shown) complementary to that of 17. Optional disc or spacer ring 44 is shown which is useful for restricting the specific types of lamps which may be inserted into the adapter. The disc or spacer ring has an inner perimeter 12 of a specific shape matched to the corresponding underside male plug locator portion of a lamp to be employed in order to only permit a single type of lamp to be employed. Also shown in FIG. 1A is ballast 61. FIG. 1B shows an alternate embodiment of an adapter according to the invention wherein one of the wires from the connector portion is connected to the tip contact portion of the adapter.

Figure 2:
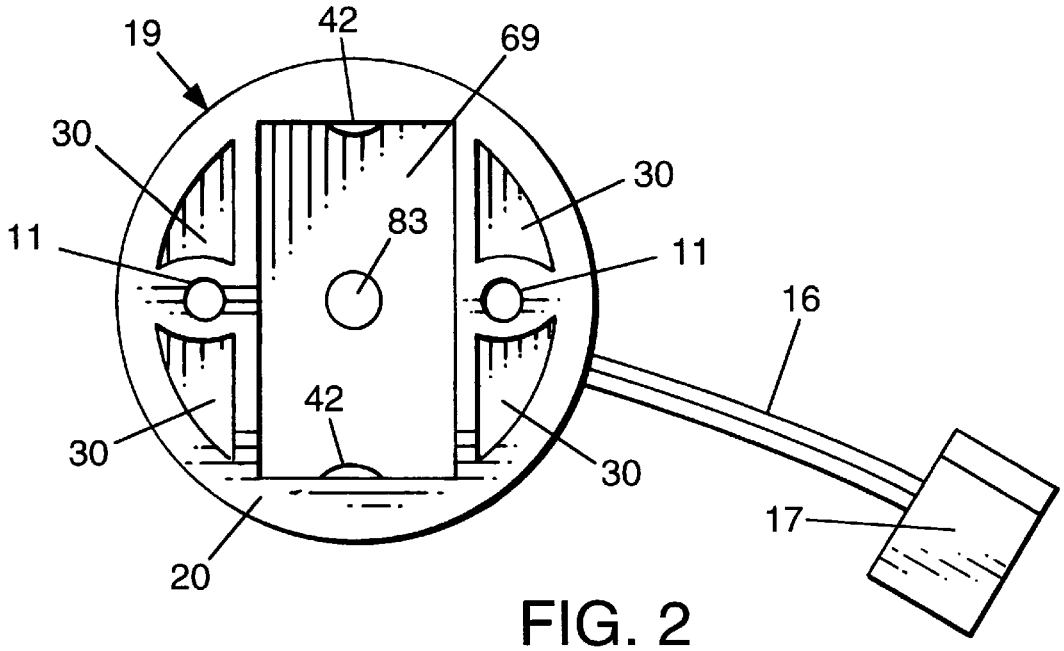
FIG. 2 is a top view of the adapter of the invention.

FIG. 2 depicts the top view of the adapter from FIG. 1A wherein 19 is the lamp-receiving portion, and 42 are locator slots or grooves in the female socket portion 69 which serve to assist and maintain the proper positioning of the fluorescent lamp in the lamp-receiving portion. Voids in the construction 30 are shown which are merely empty cavities resulting from the injection molding process from which the device is preferably made. A plurality of means for establishing electrical contact with the lamp employed 11 are shown, as well as the ballast connective means and plug portion 17. There is a void or hole in the floor portion of the substantially-rectangular female socket portion 69 which is convenient for assembly of the device. The surface 20 of the lamp-receiving portion is also shown. The spacer 44 is not shown.

Figure 3:
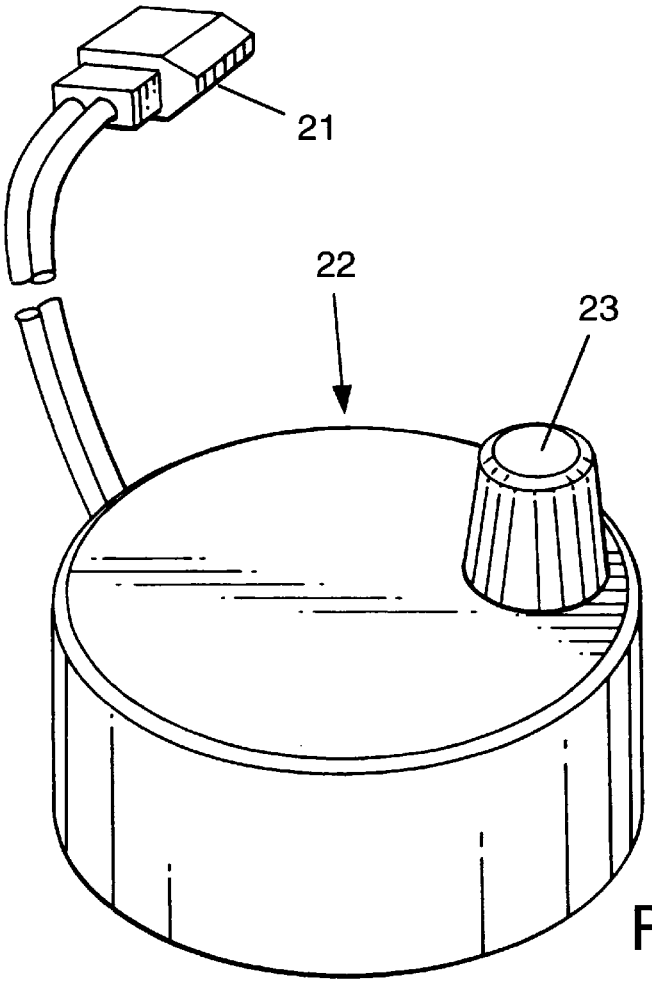
FIG. 3 is a perspective view of a ballast housing useful with the invention.
Figure 4:
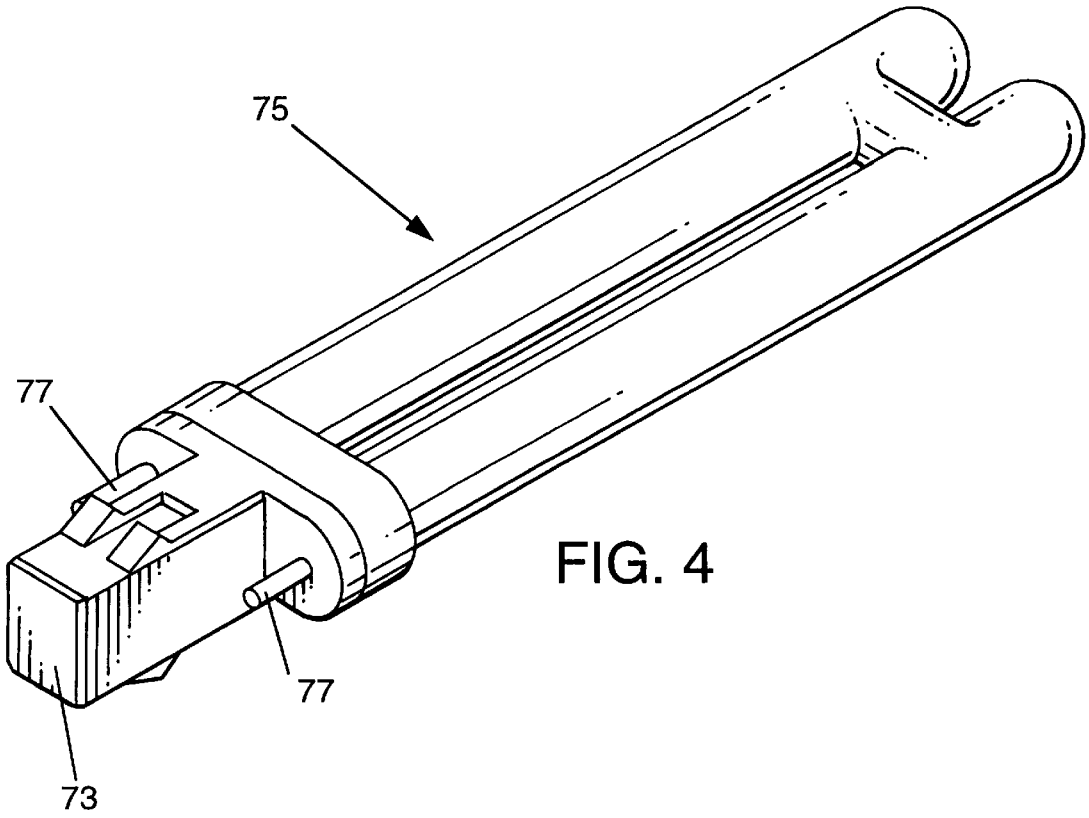
FIG. 4 is a perspective view of an arc discharge lamp useful with the invention.
Figure 5:
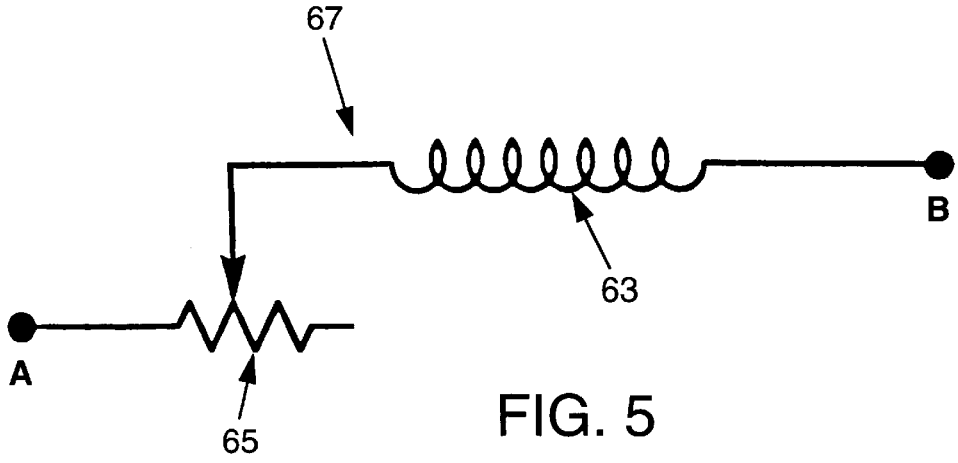
FIG. 5 is a schematic representation of a potentiometer in series with a coil of wire which is useful as dimmer with the invention.

In FIG. 3 is shown a ballast housing 22 useful in accordance with the instant invention. Within the housing are located the ballast itself (not shown) and a potentiometer (not shown) in a series circuit with the ballast. Adjusting knob 23 is in mechanical contact with the potentiometer in order that dimming of a lamp to which this ballast assembly is connected may be effected by a mere turning of the knob. The resistance value range and voltage rating of the potentiometer is readily determinably by one of ordinary skill, to the desired level of dimming. Finally, there is a connector 21 which is complementary to that depicted in FIG. 1A and FIG. 2 as 17. FIG. 4 shows an arc-discharge lamp 75, having a protruding male portion 73 and trigger terminals 77, which are power supply contacts for the arc-discharge lamp. FIG. 5 shows a potentiometer 65 and a coil of wire 63 which are connected in series with respect to one another.

A critical aspect of the instant invention is that the spacer 44 and the connector pair 17/21 may be selected so that it is not possible to mis-match the ballast with the lamp employed. In other words, an adapter having a given spacer will also only utilize a particular connector pair. In this regard, it is therefore impossible for a ballast which is improper to use for a given lamp to ever be incorrectly employed. This is an advantage which both saves fluorescent lamps and increases the safety of use of the retrofit system taught herein.

Although FIG. 1A shows an adapter suitable for use with a four pin fluorescent lamp, the same principles apply to the use of a two-pin lamp. Typically, two-pin lamps contain built-in starters making the presence of starter 14 and pins 72 within the adapter unnecessary in those cases when two pin lamps are utilized. It is often also found that certain ballasts include a starter as an integral part of their construction. In such cases, the ballast connective means 16 may include such other wires as are necessary to communicate electrical energy from the source, to the starter, and to the lamp itself The principles remain the same, while the location of the starter may vary.

There is no limit to the type of ballasts which are useful in the present invention. In fact, a variety of ballasts can be used with the same lamp, including computer-controlled ballasts which are well-known to those of ordinary skill in this art. It is easy, in accordance with the teachings herein, to change the ballast used as the conditions under which the lamp operates vary. The use of ballasts in fluorescent lighting have been known for quite some time. As an example, the Robertson Transformer Company of Rochester, Ind. supplies a wide variety of transformers and in particular their Catalog Number SP 1322 P transformer serves as an excellent and preferred ballast in accordance with this invention when used in conjunction with a 13 watt fluorescent lamp, model PL-C13W/27 available from Phillips Electronics Ltd. of Scarborough, Ontario, Canada. The ballasts suitable herein may or may not have a metallic core, such as mu-metal or other core materials well-known to those skilled in the art of ballasts useful for fluorescent lamps. The type and shape of ballast to be used is readily determinable by one of ordinary skill from considerations of the wattage rating of the lamp employed and the line voltage.

The lamp type used is preferably that of the aforementioned which is available from Phillips Electronics, Ltd. However, nearly any compact fluorescent lamp is adaptable for use in conjunction with the adapter taught herein, provided that the ballast used and the spacer 44 is matched thereto. Again, the type and shape of ballast to be used is readily determinable by one of ordinary skill from considerations of the voltage and wattage rating of the lamp employed.

Arc discharge lamps generally consist of an evacuated space such as a tubular glass envelope having a plurality of electrodes disposed within the glass envelope and which are accessible from the outside of the envelope. In principle, a potential is applied across the electrodes, and an electrical current is caused to flow through the glass envelope which results in electronic excitation of the matter disposed within the glass envelope. It is the matter disposed within the envelope which is responsible for conferring conductance to the envelope as a whole, for if the envelope were completely evacuated, no current could flow. Various media are used to render discharge tubes conductive to electrical energy with elemental mercury being by far the most common as such material is the gas by which the common fluorescent tubes observed daily are made conductive. However, other metals, gases, such as the noble gases and mixtures of these materials with one another have been used with equal success, the choice of metal or gas being dependent upon the desired light frequency and thermodynamic efficiency factors. It is usually necessary, as is well-known to those for ordinary skill in this art, to provide a momentary pulse (or trigger) of ultra high voltage to the gaseous metal atoms disposed within the envelope, in order to provide initial excitement from which the mass of gas as a whole becomes conductive. As used in this specification and the appended claims, the words "arc discharge lamp" means any lamp or discharge tube capable of producing light energy under the stimulation of an applied electrical voltage, whether or not a trigger voltage need be applied to initiate the production of light energy, and wherein the number of lumens produced per watt of energy consumed is greater than that normally encountered when using commercially available incandescent light sources which are in popular use in homes. As used herein, arc discharge lamp includes fluorescent lamps such as those commercially available under the moniker "fluorescent lamp", High Intensity Discharge lamps, such as those which employ a metallic vapor as the conducting means, as well as those which employ noble gases, including xenon discharge tubes.

Various connectors are known in the electrical arts for providing a coupling between two devices or a device and a power supply, etc. which is readily connectable or detatchable. The automotive industry employs a wide range of such connectors on all vehicles produced. The type and configuration of the connectors employed are not critical, provided that connections of integrity result from the mating of the two connector halves.

The starter for use in the combinations taught herein may be any one of several types well-known and available for use with fluorescent lighting systems. It is one of the major advantages of this invention to be able to use essentially any one of several thousands of starter/ballast/lamp combinations desired in a particular application. The field of fluorescent lamp starters is well-developed and several types are known to those of ordinary skill in this field.

Fluorescent lamps are generally known to be of either the two-prong type or the four-prong type. In the two prong type, each of the prongs serve as lamp power supply contacts, that is—it is through them that electrical energy is communicated from the power source to the inside of the arc-discharge tube. Typically, such prongs are pin-shaped. In the four-prong variety, of which common 48 inch fluorescent lamps are an example, two of the prongs are used as lamp power supply contacts, while the remaining two serve as starter electrodes across which is applied a momentary high voltage pulse whose function is to ionize the gas in the tube to the extent that current may flow from one lamp power supply contact to the other.

Although the present invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims which now follow.

I claim:

1. An adapter for retrofitting incandescent lamp sockets with arc-discharge lamps which comprises:

a) a base portion which includes a threaded contact portion and a tip contact portion, wherein said threaded contact portion and said tip contact portion are configured to be screwed into a standard incandescent lamp socket;

b) a lamp-receiving portion having a top surface portion and a side portion, said lamp-receiving portion attached to said base portion and wherein said lamp-receiving portion includes a female plug portion adapted to receive a male portion of an arc-discharge lamp complementary thereto, said lamp-receiving portion further comprising a first means for establishing electrical contact between a power supply contact on the lamp and said tip contact portion of said base portion;

c) a first electrical connector exiting the side of said lamp-receiving portion, said first electrical connector comprising contacts for a first and a second wire, wherein said first wire is connected to the threaded contact portion of said base portion, said first electrical connector being adapted to receive a complementary second electrical connector.

2. An adapter for retrofitting incandescent lamp sockets with arc-discharge lamps which comprises:

a) a base portion which includes a threaded contact portion and a tip contact portion, wherein said threaded contact portion and said tip contact portion are configured to be screwed into a standard incandescent lamp socket;

b) a lamp-receiving portion having a top surface portion and a side portion, said lamp-receiving portion attached to said base portion and wherein said lamp-receiving portion includes a female plug portion adapted to receive a male portion of an arc-discharge lamp complementary thereto, said lamp-receiving portion further comprising a first means for establishing electrical contact between a power supply contact on the lamp and said threaded contact portion of said base portion;

c) a first electrical connector exiting the side of said lamp-receiving portion, said first electrical connector comprising contacts for a first and a second wire, wherein said first wire is connected to the tip contact portion of said base portion, said first electrical connector being adapted to receive a complementary second electrical connector.

3. The adapter of claim 1 wherein said female plug portion is substantially rectangular in cross section.

4. The adapter of claim 1 further comprising:

d) a fluorescent starter as an integral part of said adapter, wherein said starter is capable of applying a trigger voltage to said arc-discharge lamp sufficient to cause the matter within the confines of said lamp to become conductive.

5. The adapter of claim 1 wherein said means for establishing electrical contact includes at least one female socket disposed within said lamp receiving portion.

6. The adapter of claim 5 wherein said female socket is complementary to a power supply contact on the lamp.

7. The device according to claim 1 further comprising a ballast connected to said first and second wires by means of a second electrical connector that is complementary to said first electrical connector, wherein said ballast comprises a dimming device.

8. The adapter of claim 7 wherein said dimming device includes a potentiometer in series with a coil of wire.

9. The adapter of claim 8 wherein said coil includes a metal core.

10. The adapter according to claim 1 further comprising:

d) a ballast contacted to said first electrical connector.

11. The adapter according to claim 6 further comprising:

e) an arc-discharge lamp having a protruding male portion at its base; and f) a spacer disc disposed on the top surface portion of the lamp-receiving portion and having an inner contour which is complementary to that of said protruding male portion, wherein the male portion of said arc-discharge lamp is located within said inner contour of said lamp-receiving portion.

12. The adapter according to claim 7 wherein said ballast is in a series circuit between said threaded contact portion and said tip contact portion.

13. The adapter of claim 12 wherein said ballast includes a starter, and wherein said arc-discharge lamp includes trigger terminals.

14. The adapter of claim 13 wherein said ballast connective means includes means for contacting said starter with the trigger terminals of said arc-discharge lamp.

15. The adapter of claim 12 wherein said arc-discharge lamp has a wattage in the range of about 1 to 150 Watts.

16. The adapter of claim 15 wherein said arc-discharge lamp has a wattage in the range of about 5 to 50 watts.

* * * * *